United States Patent [19]

Hundebol

[11] Patent Number: 4,637,173

[45] Date of Patent: Jan. 20, 1987

[54] ROTATING GRINDING OR POLISHING DISC

[75] Inventor: Keld O. Hundebol, Ansager, Denmark

[73] Assignee: Udviklingscentret Hansen & Hundebol A/S, Ansager, Denmark

[21] Appl. No.: 694,686

[22] Filed: Jan. 25, 1985

Related U.S. Application Data

[63] Continuation-in-part of Ser. No. 395,001, Jun. 30, 1982, Pat. No. 4,518,452.

[30] Foreign Application Priority Data

Nov. 24, 1980 [DK] Denmark ..... 4998/80
Nov. 20, 1981 [WO] PCT Int'l Appl. ..... PCT/DK81/00104

[51] Int. Cl.[4] ..... B24B 9/02

[52] U.S. Cl. ..... 51/334; 51/397; 15/182; 156/308.4; 156/295

[58] Field of Search ..... 51/395, 404, 376–378, 51/409, 330–337, 182, 293, 397; 15/197, 198, 213, 181, 199, DIG. 3, 182; 156/256, 257, 260, 275.1, 275.3, 275.5, 322, 295, 308.4, 323, 227, 211

[56] References Cited

U.S. PATENT DOCUMENTS

| | | | |
|---|---|---|---|
| 349,727 | 9/1886 | Luddy | 15/182 |
| 1,152,180 | 8/1915 | Jarvis | 15/182 |
| 2,024,691 | 12/1935 | Kent | 51/397 |
| 2,294,480 | 9/1942 | Rohweder | 300/21 |
| 2,698,783 | 1/1955 | Jones | 51/293 |
| 2,879,631 | 3/1959 | Peterson | 51/397 |
| 2,984,598 | 5/1961 | Gobalet | 156/322 |
| 3,120,724 | 2/1964 | Mockiewicz | 51/397 |
| 3,134,703 | 5/1964 | Listner | 156/308.4 |
| 3,451,093 | 6/1969 | McAleer | 51/334 |
| 3,727,353 | 4/1973 | Pixley | 51/376 |
| 3,971,688 | 7/1976 | Abbott | 156/295 |
| 4,365,448 | 12/1982 | Wilson | 51/334 |

*Primary Examiner*—Harold D. Whitehead
*Attorney, Agent, or Firm*—Burgess, Ryan & Wayne

[57] ABSTRACT

A rotating grinding or polishing device includes a number of grinding or polishing discs formed of two or more layers of segments radiating from a central retaining area having an edge which defines a central hole. In the central area, the segments are kept together by a heat-activatable string which also maintains the grinding or polishing disc in the form of a ring, whereby the disc has the required optimum stiffness/flexibility for obtaining an effective grinding or polishing finish so that even complex surfaces can be effectively ground or polished.

5 Claims, 3 Drawing Figures

ROTATING GRINDING OR POLISHING DISC

REFERENCE TO RELATED APPLICATION

This application is a continuation-in-part application of U.S. patent application Ser. No. 395,001, now U.S. Pat. No. 4,518,452 issued May 21, 1985 and filed June 30, 1982, to the same applicant, entitled "Method for Producing a Grinding or Polishing Disc and a Machine for This Purpose".

BACKGROUND OF THE INVENTION

This invention relates to a grinding or polishing device of the type consisting of one or more substantially circular grinding or polishing discs, each having a central hole and radial grinding or polishing segments arranged along the periphery thereof.

Such rotating grinding or polishing devices are used, for example, for grinding or polishing furniture parts, such as louvered or panelled doors. However, it is very often difficult to obtain a good and uniform grinding or polishing finish, because the parts will often have a very complex shape with projections, hollows, grooves and the like.

A rotating grinding or polishing device of this type is described in U.S. Pat. No. 2,879,631, disclosing a brush. This brush consists of a large number of slits or slotted sheets of stiff sheet material coated with abrasive materials, which sheets by the folding thereof, are retained in a metal channelform back element.

This structure, however, is encumbered with several drawbacks. It is, for example, costly as well as inconvenient to use a metal channelform element. The manner of assembling the grinding or polishing disc is also disadvantageous because the segments cannot be fully joined together. This will have the effect of the segments relatively often breaking off.

It is a further drawback that the segments can only with difficulty turn their abrasive surfaces in towards the object bacause they are made of a stiff material, such as thin spring steel. This will produce an uneven and poor grinding or polishing finish.

Finally, this known structure is rather heavy, which will necessitate a comparatively powerful motor and which will also impair the polishing quality.

All things considered, this known structure cannot grind or polish wooden objects, for example, which are not quite even, because the segments simply cannot follow the configuration of the object. At the same time, the brush is both expensive and difficult to manufacture.

OBJECTS AND SUMMARY OF THE INVENTION

The object of the invention is therefore to provide a lightweight and inexpensive grinding or polishing device that is capable of grinding or polishing even very complex surfaces.

This object is achieved according to the invention in that each grinding or polishing disc is provided with two or more substantially parallel layers of grinding or polishing segments, and that the segment layers along the edge of the central hole are maintained together by a binding material situated between the layers.

The grinding or polishing device according to the invention is very inexpensive to manufacture because no complicated metal parts are required for holding together the individual grinding or polishing discs. Thus, the grinding or polishing device is not heavy, which will make it possible to use a smaller and less expensive motor. Since the grinding or polishing segments are effectively retained, the grinding or polishing device can last for a comparatively long time. The grinding or polishing performance is good because the segments will bend in such a manner that the grinding or polishing coated surfaces will follow the surfaces of the object for a comparatively large part of a turn.

The light segments can follow "hollows or grooves" in the object because the rotation will carry them outwards. The grinding or polishing quality will also be high because each individual segment can follow the object freely, but nevertheless have such stiffness that, for example, knots or projections are also ground or polished.

As disclosed, a grinding or polishing disc according to the invention has along the entire circumference at the edge of the central hole thereof, binding material extending somewhat radially for forming a retaining area. There is thus achieved a high degree of durability of the grinding or polishing disc and, at the same time, a suitable stiffness of the retaining area. This stiffness has proved to be of great importance to the quality of the grinding or polishing finish because the segments must follow the configuration of the object but still engage the same with a certain pressure.

If the two layers of segments, as disclosed, are formed integrally, the grinding or polishing disc being made from a substantially rectangular slitted sheet material as disclosed in copending U.S. Pat. No. 4,365,448, the entire disclosure of which is incorporated herein by reference, there is obtained a very easily manufactured and inexpensive grinding or polishing disc with the smallest possible consumption of material. Moreover, there is sufficient distance between two adjacent segments so that they are freely movable.

It is advantageous if, as disclosed, the binding material is a heat-activatable material. It is thereby possible to easily form a suitably wide retaining area by pressing the grinding or polishing disc between two heated jaws.

In a preferred embodiment of the invention, the heat-activatable material has the shape of a string. By at least letting the ends of the string meet, the string will keep the ring together, while at the same time, ensuring the stiffness in the retaining area.

A further strong grinding or polishing disc is obtained if the string encircles the central hole several times, as is disclosed. It is thereby possible to quite exactly prepare the retaining area by means of the number of windings, and the ring is kept together in a safe manner.

Finally, it is advantageous if the grinding or polishing device is designed as disclosed, the rings ensuring a sufficiently large distance between two grinding or polishing discs so that the segments thereof are freely movable.

BRIEF DESCRIPTION OF THE DRAWINGS

The invention will be further described in the following with reference to the drawing, wherein.

DETAILED DESCRIPTION OF A PREFERRED EMBODIMENT

Figure 1:
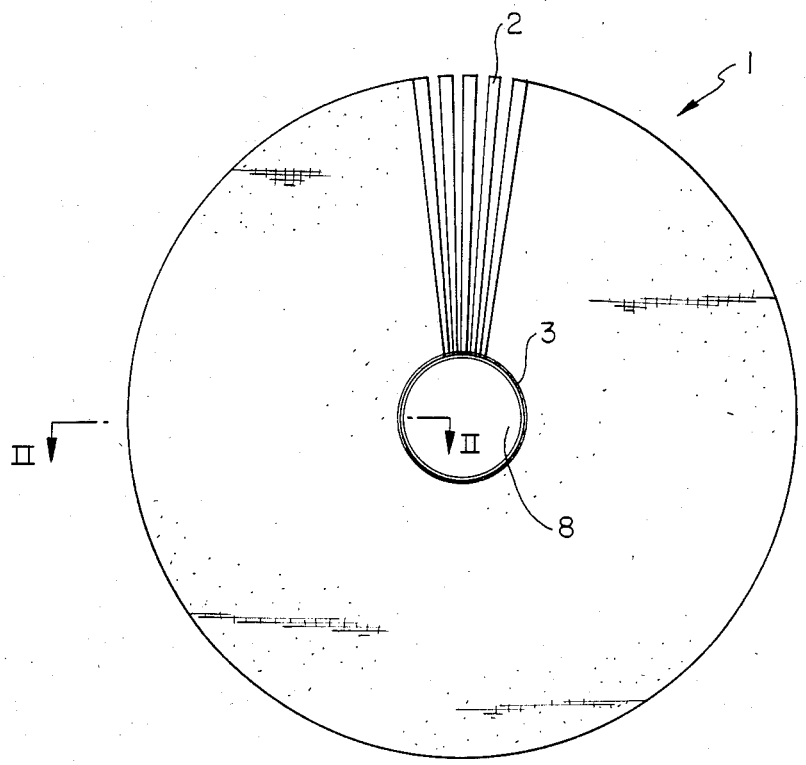
FIG. 1 is a top plan view of a grinding or polishing disc for a grinding or polishing device, according to the present invention.

Referring to the drawings in detail, and initially to FIG. 1 thereof, there is shown a grinding or polishing disc 1 according to the present invention formed of two layers 2*a* and 2*b* formed of segments 2 radiating from a retaining area around a central hole 8. The grinding or polishing disc is, for example, made of cloth coated with an abrasive coating 9 but the use of other materials is also possible.

Figure 2:
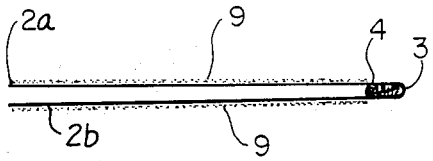
FIG. 2 is a cross-sectional view through the grinding or polishing disc in FIG. 1, taken along line II—II thereof.

As will particularly be seen from FIG. 2, the abrasive coating 9 is provided on the outside of the cloth layers.

By the edge 3 which defines hole 8, the two layers have been joined by melting a string 4 of a heat-activatable material between the layers. There is thus obtained a retaining area being suitably stiff but nevertheless flexible.

These properties are very important to an effective grinding or polishing finish.

It is therefore possible to use materials other than heat-activatable ones. The use of various kinds of glue or the like is thus possible.

During the grinding or polishing process, the segments 2 will bend so that the abrasive coating follows the surface of the object. If desired, the bending may be facilitated by weakening lines.

Figure 3:
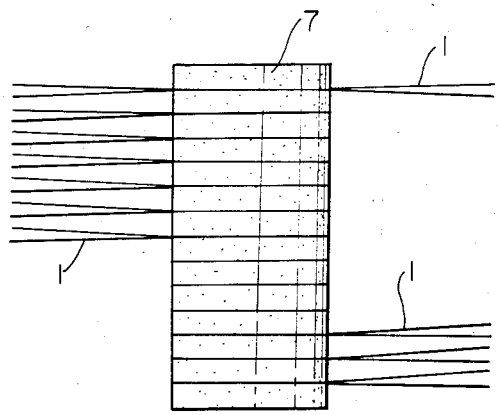
FIG. 3 is an elevational view of a number of grinding or polishing discs assembled to form a grinding or polishing device according to the present invention.

FIG. 3 clearly shows how a number of grinding or polishing discs 1 are assembled to form a grinding or polishing device having intermediate rings 7.

Apart from retaining the discs 1, the rings 7 are intended to provide a suitable distance between the segments 2 so that these are freely movable. The rings 7 are advantageously made of foamed material such as polystyrene, the rings 7 thereby being light as well as strong. It is of course possible to make use of other suitable materials. One possible arrangement of the rings 7 and discs 1 is shown and described in copending U.S. Pat. No. 4,365,448, the entire disclosure of which has been incorporated herein by reference.

The heat-activatable string 4 encircles the hole 8 several times thereby obtaing a strong disc with good properties. It has been found that grinding or polishing discs 1 having a diameter of approximately 30 cm, a central hole 8 of approximately 10 cm and a width of the segments of approximately 5 mm have outstanding abrasive properties. In this respect, it is important that the segments are of suitable width, since otherwise, it will not be possible to adjust the grinding or polishing process. Finally, the rings 7 are advantageously almost twice as thick as the width of the segments 2.

It is essential to the grinding or polishing process that there is comparatively good space between the segments. The segments thereby do not become entangled during the process, which would result in reducing the abrasive effect and causing damage to the grinding or polishing device.

It is also important that the segments are dimensioned so as to be able to freely follow the surface of the object.

When working with lacquered objects, the present invention eliminates the need for an expensive, manual grinding or polishing process, because the small fiber formed by usual rough grinding methods can now for the first time be machined away by a grinding or polishing device according to the present invention. The present device possesses the optimum combination of distance between segments, flexibility of segments, stiffness in the retaining area and the possibility of fast rotation, namely between 900 and 1200 revolutions per minute. Therefore, the grinding or polishing device according to the present invention has also proved to be superior to all other makes in the market since no grinding or polishing devices whatsoever can grind or polish with an equally high quality as the grinding or polishing device according to the present invention.

I claim:

1. A grinding or polishing disc comprising:

a member formed from a substantially rectangular slitted, flat sheet of material folded and shaped to have a central ring defined by two substantially parallel layers joined at an edge having a circular configuration which defines a central hole;

radial grinding or polishing segments extending radially from the central ring in two substantially parallel layers; and a string of adhesive material situated between the parallel layers along said edge of said central ring for securing the two layers of said central ring together and maintaining said sheet in said circular configuration.

2. A grinding or polishing disc according to claim 1, wherein the adhesive material extends radially from said edge within said central ring for forming a retaining area.

3. A grinding or polishing disc according to claim 1, wherein the adhesive material is a heat-activatable material.

4. A grinding or polishing disc according to claim 1, wherein the string encircles the central hole several times.

5. A grinding or polishing device comprising a number of grinding or polishing discs, as defined by claim 1, and a plurality of rings for joining said discs around a common axis with each disc being spaced from an adjacent disc by at least one ring.

* * * * *